US006732876B2

(12) United States Patent
Belcastro

(10) Patent No.: US 6,732,876 B2
(45) Date of Patent: May 11, 2004

(54) AUTOMATICALLY SEALING LID ASSEMBLY

(75) Inventor: Domenic Belcastro, Fraser, MI (US)

(73) Assignee: Niko Products, Inc., Shelby Township, MI (US)

( * ) Notice: Subject to any disclaimer, the term of this patent is extended or adjusted under 35 U.S.C. 154(b) by 209 days.

(21) Appl. No.: 10/044,002

(22) Filed: Jan. 11, 2002

(65) Prior Publication Data

US 2002/0092851 A1 Jul. 18, 2002

Related U.S. Application Data

(60) Provisional application No. 60/261,444, filed on Jan. 13, 2002.

(51) Int. Cl.[7] ..... B65D 51/18

(52) U.S. Cl. ..... 220/253; 220/254.4; 220/254.5; 220/715; 220/823; 222/484; 222/548; 222/507

(58) Field of Search ..... 220/719, 253, 220/254.2, 254.3, 254.4, 254.5, 254.7, 367.1, 373, 714, 715, 711, 823, 821; 215/309, 315, 387; 222/484, 548, 507, 516

(56) References Cited

U.S. PATENT DOCUMENTS 2,636,649 A * 4/1953 Corriveau ..... 222/516
3,410,462 A * 11/1968 Donovan ..... 222/516
4,171,060 A * 10/1979 Howard et al. ..... 220/254.4
4,712,704 A * 12/1987 Ramsey et al. ..... 220/254.4
5,143,248 A * 9/1992 Sawatsky ..... 220/711
5,165,581 A * 11/1992 Uhl ..... 222/480
5,294,014 A * 3/1994 Wyatt et al. ..... 220/253
5,921,425 A * 7/1999 Markey ..... 220/254.4
6,234,364 B1 * 5/2001 Nybakke et al. ..... 222/469
6,561,371 B2 * 5/2003 Sciarini ..... 215/236

* cited by examiner

*Primary Examiner*—Robin A. Hylton
(74) *Attorney, Agent, or Firm*—Artz & Artz, P.C.

(57) ABSTRACT

An automatically sealing lid assembly (10) includes a cap portion (12) selectively coupled to a cup (16) so as to cover a mouth (14) of the cup (16). The cap portion (12) has a sip hole (34) and a vent hole (36) integrally formed therein. The cap portion (12) also has a disk portion (42) rotatably coupled thereto between a sealed configuration and an unsealed configuration. The disk portion (42) has a sip plug (52) and a vent plug (54). The sip plug (52) seals the sip hole (34) in the sealed configuration. Likewise, the vent plug (54) seals the vent hole (36) in the sealed configuration. The cap portion (12) and the disk portion (42) have a biasing member assembly (62) operatively coupled therebetween. The biasing member assembly (62) biases the disk portion (42) to the sealed configuration. The biasing member assembly (62) further includes an actuating surface (80) for receiving an application of force by a user thereby selectively disposing the lid assembly (10) to the unsealed configuration.

16 Claims, 4 Drawing Sheets

AUTOMATICALLY SEALING LID ASSEMBLY

CROSS-REFERENCE TO RELATED APPLICATIONS

The present invention claims priority from U.S. Provisional Application Serial No. 60/261,444 filed on Jan. 13, 2002, and entitled "No Spill Travel Mug."

TECHNICAL FIELD

The present invention relates generally to drink containers, and more particularly to automatically sealing lid assemblies for automatically sealing beverages within drink containers.

BACKGROUND OF THE INVENTION

Cups are drink containers that are in common use today. Users drink from cups under a wide variety of circumstances in which the beverages are highly susceptible to being unintentionally spilled. These circumstances include, for example, operation of a vehicle, participation in sports, walking, etc. Due to the fluid nature of beverages, spills commonly occur through the open mouths of cups when the cups are jarred, tipped, dropped, or otherwise subjected to sudden movements.

Spills also frequently result from opening sealed drink containers having unexpected pressure build-up therein. For example, jarring a sealed container having a carbonated beverage therein typically causes the pressure to increase therein. Subsequently opening the container typically causes the beverage to unexpectedly gush out of the opening due to the pressure build up. Further, sealed containers having hot beverages contained therein may similarly release a small burst of hot steam upon opening the container. Since users obviously wish to prevent accidental spills, it is desirable to secure the beverage within the cup without adversely increasing the pressure therein.

One proposed solution for eliminating accidental spills associated with cups employs the use of a lid that snaps onto the rim of a cup. These lids are commonly found in fast food restaurants and coffee outlets. The lid has one or more holes to allow a user to access the beverage. By reducing the size of the opening through which the beverage exits the cup, the likelihood of spills is subsequently reduced.

However, these lids fail to eliminate accidental spills because the beverage may still escape through the opening despite its reduced size. For instance, jarring the cup can cause the beverage to splash out of the cup through its opening even though the cup may be in an upright position. Moreover, the beverage can still pour out of the cup through the opening if the cup is tipped onto its side. If the cup is dropped, the lid can be dislodged from the cup and the entire contents of the cup can be lost.

Another proposed solution involves a cup and a lid that is secured to the cup by a threaded engagement. One variation of this solution further requires a lid having a hole formed therein for the purpose of allowing a straw to pass through the lid. This variation also includes a cap to be manually placed on the end of the straw in order to seal the beverage within the cup. Another variation involves a pop-up vent on the lid which seals the cup when the vent is manually pushed down and permits beverage to exit the cup when the vent is pulled up.

In both variations, the threaded engagement secures the lid to the cup to prevent the lid from being dislodged from the cup if it is dropped. Both variations also effectively prevent a beverage from splashing out of the cup if the cup is jarred in a substantially upright position. However, unless the user manually places the cap onto the straw or pushes down the pop-up vent, the beverage can spill out of the cup if it is tipped onto its side.

Yet another proposed solution is an automatically sealing drink container as disclosed in U.S. Pat. No. 5,465,866. Unfortunately, while the cup disclosed therein has improved sealability, it requires the use of a straw, which may be undesirable. Further, it is difficult to clean portions of the cup. This is disadvantageous in that if these cups are frequently reused, such as for children, they must be cleaned and washed before and after each use.

Therefore, a need exists for an improved automatically sealing drink container, and for a cup which eliminates spills while it is in a sealed configuration. Also, there is a need for such a cup which further permits the user to readily clean the entire cup device.

SUMMARY OF THE INVENTION

It is therefore an object of the present invention to automatically seal a drink container having a beverage contained therein so as to prevent accidental spills caused by agitation of the drink container and the beverage.

Another object of the present invention is to allow the release of gas from within a sealed drink container in order to prevent a build up of pressure therein and avoid causing a beverage from gushing thereout upon unsealing the container.

It is still another object of the present invention to provide an automatically sealing lid assembly that is constructed in such a manner so as to permit a user to properly sanitize the entire assembly.

In accordance with the above and other objects of the present invention, an automatically sealing lid assembly is provided. The automatically sealing lid assembly includes a cap portion selectively coupled to a drink container so as to cover an opening of the drink container. The cap portion has a sip hole and a vent hole integrally formed therein. The cap portion also has a disk portion rotatably coupled thereto and moveable between a sealed configuration and an unsealed configuration. The disk portion has a sip plug and a vent plug. The sip plug seals the sip hole in the sealed configuration. Likewise, the vent plug seals the vent hole in the sealed configuration. The cap portion and the disk portion have a biasing member operatively coupled therebetween. The biasing member biases the disk portion to the sealed configuration. The disk portion has a plunger operatively coupled thereto for selectively moving the disk portion to the unsealed configuration.

One advantage of the present invention is that the lid assembly automatically seals the drink container so as to avoid accidental spills. Another advantage of the present invention is that components of the lid assembly are detachable to permit proper sanitation of the entire assembly. It is yet another advantage of the present invention that gas is released from within the drink container so as to avoid undesirable bursts of steam or accidental spills resulting from the beverage gushing out of the drink container.

Other advantages of the present invention will become apparent when viewed in light of the detailed description of the preferred embodiment when taken in conjunction with the attached drawings and appended claims.

DESCRIPTION OF THE PREFERRED EMBODIMENT

Figure 1:
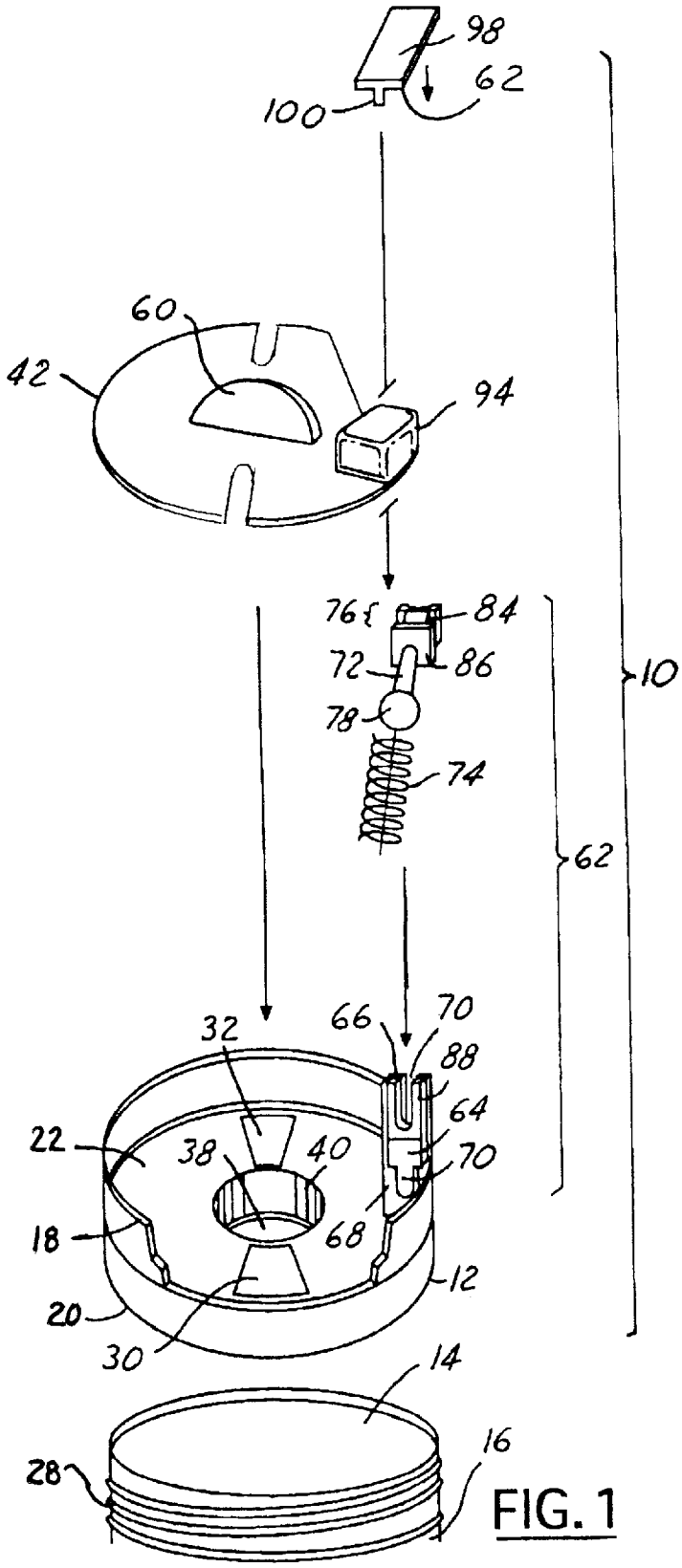
FIG. 1 is an exploded view of an automatically sealing lid assembly according to a preferred embodiment of the present invention.

In the following figures, the same reference numerals are used to identify the same components in the various views.

Referring now to FIG. 1, there is generally illustrated an exploded view of an automatically sealing lid assembly ("lid assembly") 10 according to a preferred embodiment of the present invention. The lid assembly 10 includes a cap portion 12 used to cover a mouth 14 of a cup 16.

Figure 2A:
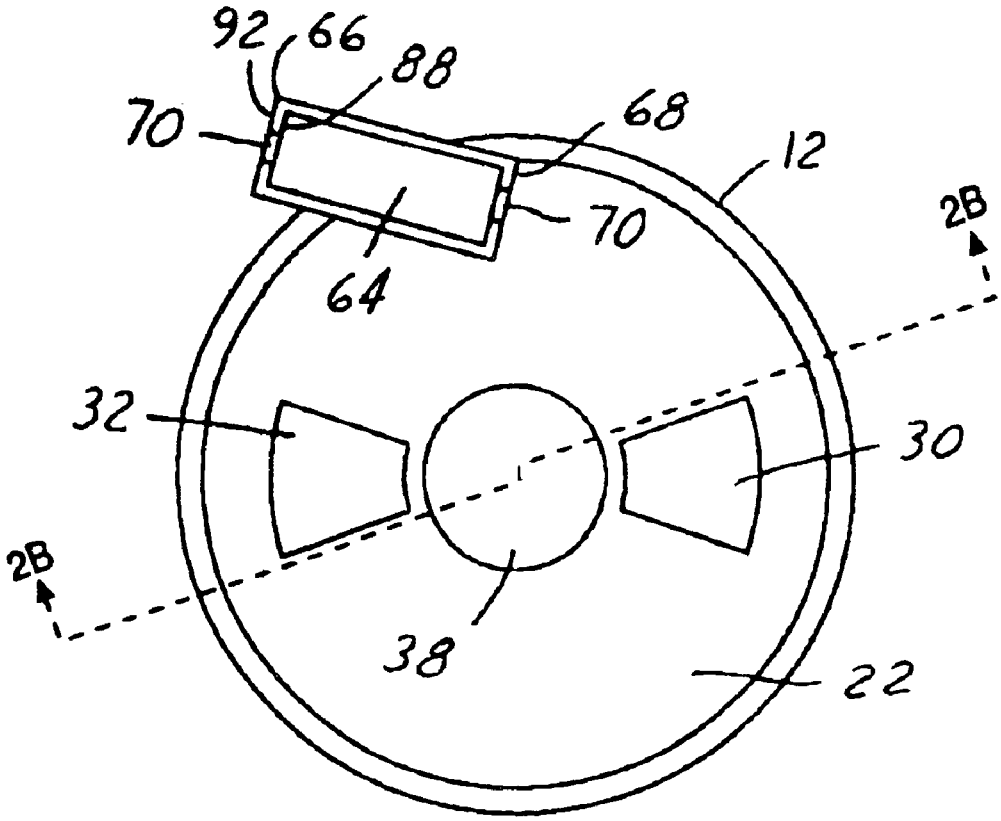
FIG. 2A is a top view of a cap portion of an automatically sealing lid assembly according to a preferred embodiment of the present invention.
Figure 2B:
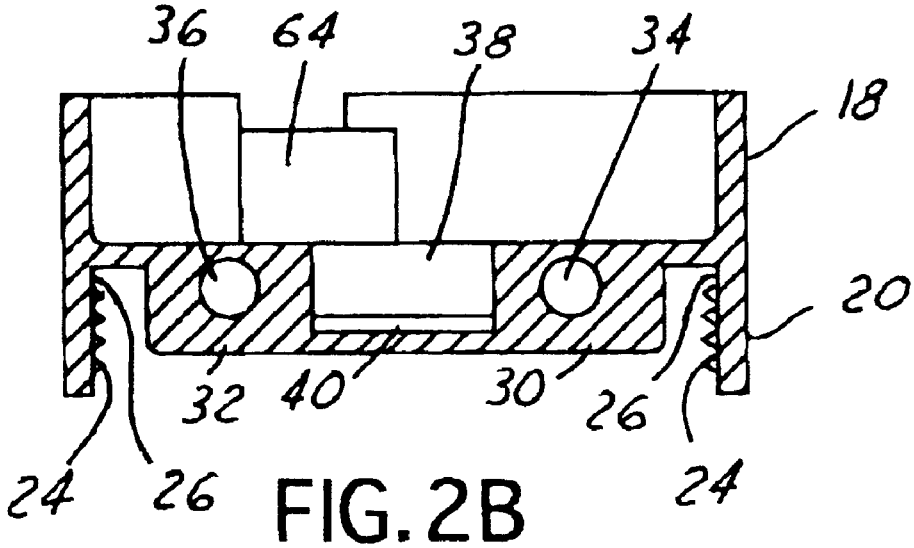
FIG. 2B is a cross-sectional view of the cap portion shown in FIG. 2A, taken along dashed line 2B—2B.

The cap portion 12 is best illustrated in FIGS. 2A and 2B. FIG. 2A shows a top view of the cap portion 12 according to a preferred embodiment of the present invention. FIG. 2B shows a cross-sectional view of the cap portion 12 in FIG. 2A, taken along dashed line 2B—2B.

As best shown in FIG. 2B, the cap portion 12 preferably includes a top collar 18 and a bottom collar 20 with a plate 22 integrally formed therebetween. The bottom collar 20 preferably has a threaded fastener 24 integrally formed on its inner surface 26 for attachment to an opposing threaded fastener 28 of the cup 16. Consequently, the plate 22 covers the mouth 14 formed within the cup 16 and encloses an interior thereof. Of course, various other fastening mechanisms may be used to releasably attach the cap portion 12 to the cup 16. Moreover, the threaded fastener 24 may be formed on the outer surface of the bottom collar 20.

The plate 22 has a sip well 30 and a vent well 32 integrally formed therewith. The sip well 30 has a sip hole 34 integrally formed therein for permitting open communication of a beverage between the interior and the exterior of the cup 16. Likewise, the vent well 32 has a vent hole 36 integrally formed therein for allowing open communication of a gas between the interior and the exterior of the cup 16.

As best shown in FIG. 2A, the sip well 30 and the vent well 32 are preferably disposed on opposite sides of a center line of the plate 22. This arrangement provides an efficient flow of air into the interior of the cup 16 through the vent hole 36 thereby allowing an efficient outflow of the beverage from the interior of the cup 16 through the sip hole 34.

Preferably, the cap portion 12 further includes a recess 38 with a groove 40 integrally formed therein for releasably coupling a disk portion 42 thereto. The disk portion 42 preferably has a spindle 44 extending therefrom with an annular flange 46 integrally formed therein (as best shown in FIG. 3C). The annular flange 46 of the spindle 44 engages the groove 40 of the recess 38 so as to provide a detachable snap-fit engagement between the disk portion 42 and the cap portion 12. The snap-fit engagement serves as a detent in a vertical direction. However, the snap-fit engagement simultaneously allows for free movement in a rotational direction thereby rotatably coupling the disk portion 42 to the cap portion 12. The snap-fit engagement also allows a user to readily detach and re-attach the two portions for a thorough cleaning of the lid assembly 10. Of course, various other arrangements may be employed to rotatably and releasably couple the disk portion 42 to the cap portion 12.

Figure 3A:
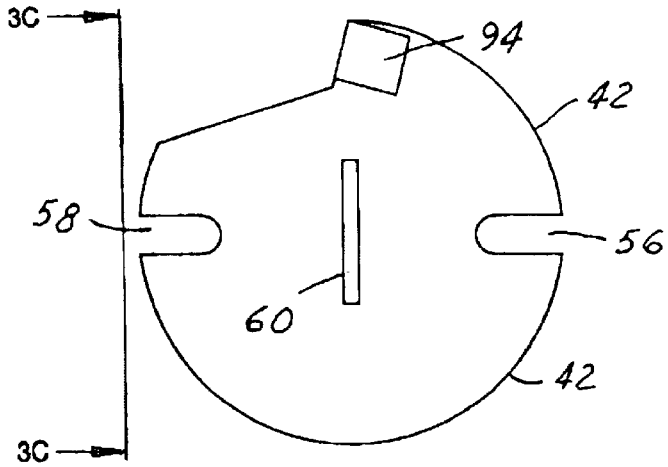
FIG. 3A is a top view of a disk portion of an automatically sealing cup according to a preferred embodiment of the present invention.
Figure 3B:
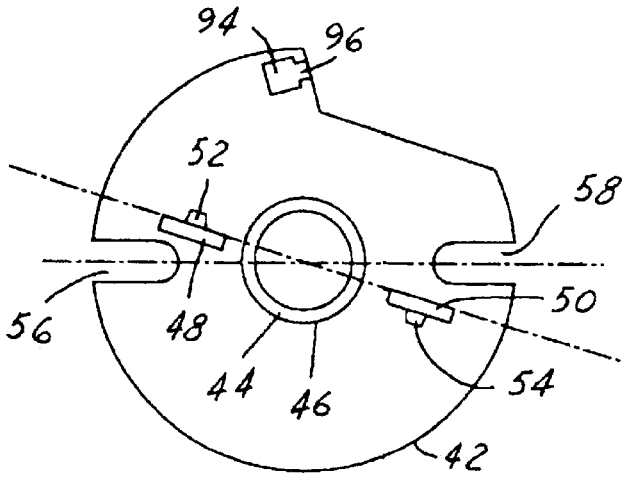
FIG. 3B is a bottom view of a disk portion of an automatically sealing cup according to a preferred embodiment of the present invention.
Figure 3C:
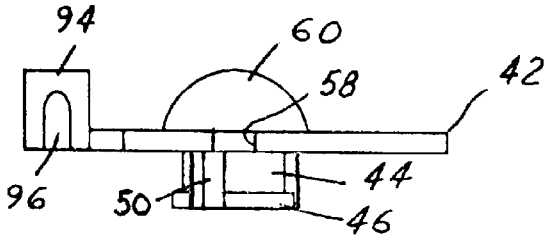
FIG. 3C is a cross-sectional view of the disk portion shown in FIG. 3B, taken along dashed line 3C—3C.

The disk portion 42 is best illustrated in FIGS. 3A, 3B, and 3C. FIG. 3A shows a top view of the disk portion 42 according to a preferred embodiment of the present invention. FIG. 3B shows a bottom view of the disk portion 42 illustrated in FIG. 3A. FIG. 3C shows a cross-sectional view of the disk portion 42 illustrated in FIG. 3B, taken along dashed line 3C—3C.

As best shown in FIG. 3B, the disk portion 42 also includes a first flange 48 and a second flange 50. The first flange 48 preferably extends perpendicularly from the disk portion 42 into the sip well 30 of the cap portion 12. The first flange 48 has a sip plug 52 integrally formed therein for selectively plugging the sip hole 34 when the lid assembly 10 is in a sealed configuration. The second flange 50 preferably extends perpendicularly from the disk portion 42 into the vent well 32 of the cap portion 12. The second flange 50 has a vent plug 54 integrally formed therein for selectively plugging the vent hole 36 when the lid assembly 10 is in the sealed configuration.

The disk portion 42 further includes a sip aperture 56 and a vent aperture 58, each integrally formed therein. The sip aperture 56 is aligned with the sip well 30 so as to permit a flow of the beverage therethrough when the lid assembly 10 is disposed in the unsealed configuration. Likewise, the vent aperture 58 is aligned with the vent well 32 so as to permit a flow of air therethrough when the lid assembly 10 is disposed in the unsealed configuration. Of course, the disk portion 42 may have various other types of apertures for permitting the flow of the beverage and the flow of the air between the interior and the exterior of the cup 16.

The sip aperture 56 is preferably offset from the sip plug 52 by a predetermined angle so as to hinder the beverage from gushing thereout. Likewise, the vent aperture 58 is preferably offset from the vent plug 54 by a predetermined angle for the same reason. For example, both apertures 56, 58 may be offset from the plugs 52,54 by about 16 degrees. The indirect flow paths of the beverage and the air hinder communication between the interior and the exterior of the cup 16 thereby impeding the beverage from gushing thereout. Of course, the arrangement between the apertures 56, 58 and the plugs 52, 54 may vary as desired.

As best shown in FIG. 3A, the disk portion 42 preferably has a handle 60 integrally formed therein for allowing a user to detach the disk portion 42 from the cap portion 12 for cleaning the lid assembly 10. Clearly, other mechanisms may be used to detach the disk portion 42 from the cap portion 12.

Referring back to FIG. 1, the lid assembly 10 further includes a biasing member assembly 62 for biasing the lid assembly 10 to a sealed configuration. The biasing member assembly 62 typically includes a trough 64 integrally formed within the cap portion 12. The trough 64 has a first end 66 and a second end 68, each with a trough aperture 70 integrally formed therein. The trough 64 is preferably intended to receive a plunger 72 and a spring 74 slidably disposed therein.

Figure 4:
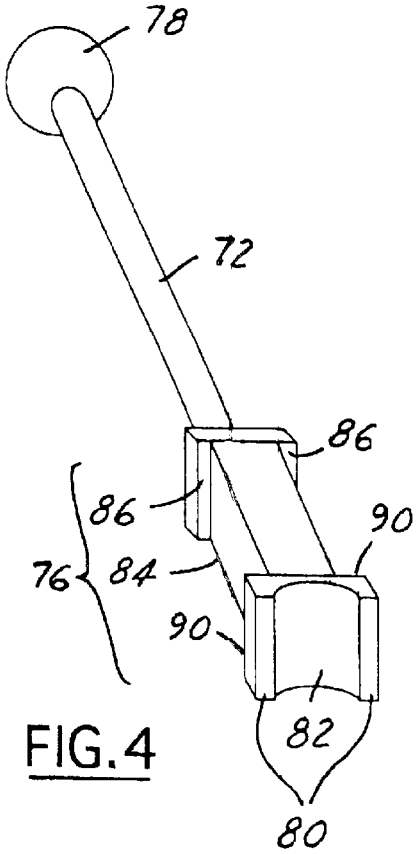
FIG. 4 is a perspective view of a plunger according to a preferred embodiment of the present invention.

Turning now to FIG. 4, a perspective view of the plunger 72 is illustrated according to a preferred embodiment of the present invention. The plunger 72 has a piston portion 76 and a ball anchor portion 78 integrally formed within opposing ends thereof. The piston portion 76 has an actuating surface 80 for receiving an application of force by a user. Preferably, the actuating surface 80 has a depression 82 formed therein for receiving the contour of the user's finger.

Figure 5A:
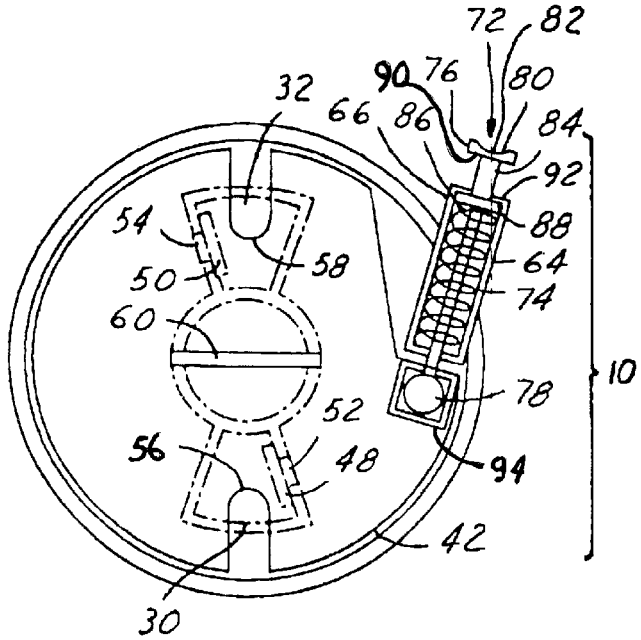
FIG. 5A is a partially cutaway view of an automatically sealing lid assembly showing a biasing member in a sealed configuration according to a preferred embodiment of the present invention.
Figure 5B:
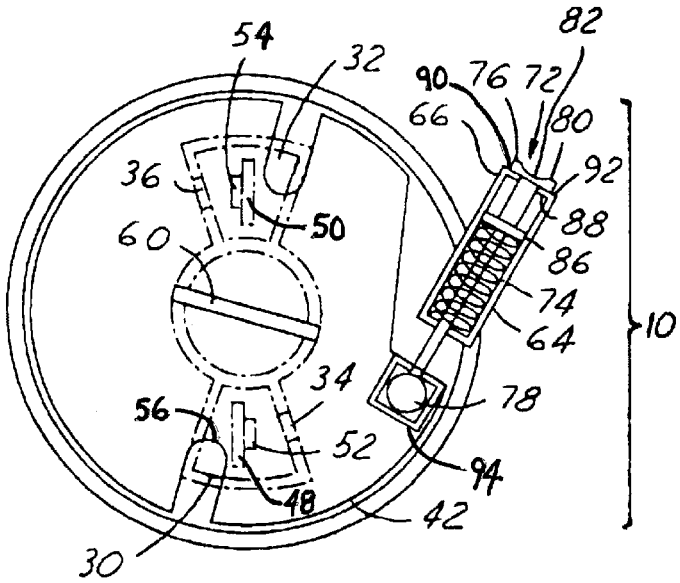
FIG. 5B is a partially cutaway view of an automatically sealing lid assembly showing a biasing member in an unsealed configuration according to a preferred embodiment of the present invention.

The piston portion 76 further includes a body portion 84 extending from the actuating surface 80 and an interior detent flange 86 coupled thereto. As best shown in FIGS. 5A and 5B, the body portion 84 is slidably disposed in the trough aperture 70 of the first end 66 of the trough 64. FIG. 5A shows a partially cutaway view of the lid assembly in a sealed configuration according to a preferred embodiment of the present invention. FIG. 5B shows a partially cutaway view of the lid assembly 10 in an unsealed configuration according to a preferred embodiment of the present invention.

As shown in FIG. 5A, in a sealed configuration, the interior detent flange 86 is mated to an interior surface 88 of the first end 66 of the trough 64. The interior detent flange 86 prevents the plunger 74 from further extending radially outward.

As shown in FIG. 5B, in an unsealed configuration, an exterior detent flange 90 is mated to an exterior surface 92 of the first end 66 of the trough 64. The exterior detent flange 90 prevents the plunger from being further disposed radially inward.

The plunger 72 extends through the trough aperture 70 of the second end 68 of the trough 64 into a casing 94 integrally formed within the cap portion 12. Thus, the ball anchor portion 78 is disposed within the casing 94. The ball anchor portion 78 is sized larger than a casing aperture 96 so as to pivotally couple the plunger 72 to the disk portion 42.

The spring 74 is operatively coupled between the second end 68 of the trough 64 and the interior detent flange 86 of the plunger 72. The spring 74 exerts a biasing force on the interior detent flange 86 thereby biasing the plunger 72 toward the first end 66 of the trough 64. As a results the spring 74 operatively biases the disk portion 42 to rotate about its spindle 44 thereby inserting the sip plug 52 and the vent plug 54 into the sip hole 34 and the vent hole 36, respectively. Thus, the spring 74 biases the lid assembly 10 to the sealed configuration.

As shown in FIG. 5A, the spring 74 applies a biasing force to the plunger 72 toward the first end 66 of the trough 64 thereby biasing the disk portion 42 to rotate in a counter-clockwise direction to the sealed configuration.

As shown in FIG. 5B, the lid assembly 10 may be disposed to the unsealed configuration by applying an actuating force on the actuating surface 80 so as to push the plunger 72 inward and rotate the disk portion 42 in a clockwise direction. The actuating force typically must be greater than the biasing force to permit the disk portion 42 to rotate in the clockwise direction. As the disk portion 42 rotates in the clockwise direction, the sip plug 52 and the vent plug 54 are simultaneously removed from the sip hole 34 and the vent hole 36, respectively. As a result, air is permitted to enter the cup 16 through the vent aperture 58 and the vent hole 36 while the beverage may concurrently exit the cup 16 through the sip hole 34 and the sip aperture 56. As a result, air is permitted to enter the cup 16 through the vent slot 58 and the vent hole 36 while the beverage may concurrently exit the cup 16 through the sip hole 34 and the sip slot 56.

Likewise, the lid assembly 10 is disposed in the unsealed configuration when the containment pressure within the cup 16 is sufficiently high so as to overcome the biasing force of the spring 74 and force the sip plug 52 and the vent plug 54 out of their respective holes 34, 36. Gas is released from the interior of the cup 16 through at least one of the sip hole 34 and the vent hole 36 thereby maintaining containment pressure below a pressure threshold. Preferably, the pressure threshold is sufficiently low so as to allow a user to unseal the lid assembly 10 without being unexpectedly sprayed with the high-pressure contents of the cup 16.

Referring back to FIG. 1, the biasing member assembly 62 also includes a trough cover 98 to engage the trough 64 so as to enclose the plunger 72 and the spring 74. The trough cover 98 has at least one nub 100 extending therefrom for engaging the trough apertures 70 in a detachable press-fit engagement. Consequently, the trough cover 98 may be readily detached and re-attached to provide access to the biasing member assembly 62 and allow thorough cleaning thereof. Of course, the biasing member assembly 62 may be various other mechanisms as desired.

While particular embodiments of the invention have been shown and described, numerous variations and alternate embodiments will occur to those skilled in the art. Accordingly, it is intended that the invention be limited only in terms of the appended claims.

What is claimed is:

1. An automatically sealing lid assembly for automatically sealing an opening of a drink container, the assembly comprising:

a cap portion selectively coupled to the drink container so as to cover the opening of the drink container, said cap portion having a sip hole and a vent hole integrally formed therein;

a disk portion rotatably coupled to said cap portion and moveable between a sealed configuration and an unsealed configuration, said disk portion having a first flange with a sip plug extending therefrom and a second flange with a vent plug extending therefrom, said sip plug sealing said sip hole in said sealed configuration, said vent plug sealing said vent hole in said sealed configuration;

a biasing member assembly operatively coupled to said cap portion and said disk portion, said biasing member urging said disk portion to said sealed configuration; and a knob operatively coupled to said disk portion actuation of which disposes said disk portion to said unsealed configuration.

2. The automatically sealing lid assembly as recited in claim 1 wherein said cap portion has a sip well and a vent well integrally formed therein, said sip well having said sip hole integrally formed therein, said vent well having said vent hole integrally formed therein.

3. The automatically sealing lid assembly as recited in claim 1 wherein said sip hole permits a fluid to pass therethrough in said unsealed configuration, said vent hole permits a gas to pass therethrough in said unsealed configuration.

4. The automatically sealing lid assembly as recited in claim 1 wherein said disk portion has a spindle extending therefrom and said cap portion has a recess formed therein for receiving said spindle and for rotatably coupling said disk portion to said cap portion.

5. The automatically sealing lid assembly as recited in claim 4 wherein said spindle extends from a disk center of said disk portion, said spindle having an annular flange integrally formed therein.

6. The automatically sealing lid assembly as recited in claim 5 wherein said recess of said cap portion has a groove integrally formed therein for receiving said annular flange of said spindle so as to allow a detachable snap-fit engagement therebetween and permit a rotational movement of said disk portion.

7. The automatically sealing lid assembly as recited in claim 1 wherein said biasing member assembly comprises:

a trough integrally formed within said cap portion;

a plunger slidably disposed within said tough between a sealed configuration and an unsealed configuration;

a resilient member operatively coupled to said plunger and said trough so as to bias said plunger to said sealed configuration; and a casing integrally formed within said disk portion operatively coupled to said plunger for biasing said disk portion to said sealed configuration.

8. The automatically sealing lid assembly as recited in claim 7 wherein said biasing member assembly further comprises a detachable trough cover for securing said plunger and said resilient member within said trough.

9. A drink container comprising:

a cup having a cup opening;

a cap portion selectively coupled to said cup so as to cover said cup opening, said cap portion having a sip well and a vent well integrally formed therein, said sip well having a sip hole integrally formed therein, said vent well having a vent hole integrally formed therein;

a disk portion rotatably coupled to said cap portion and moveable between a sealed configuration and an unsealed configuration, said disk portion having a first flange with a sip plug extending therefrom and a second flange with a vent plug extending therefrom, said sip plug sealing said sip hole in said sealed configuration, said vent plug sealing said vent hole in said sealed configuration; and a biasing member assembly operatively coupled to said cap portion and said disk portion, said biasing member urging said disk portion to said sealed configuration, said biasing member assembly having an actuating surface for receiving an actuating force by a user.

10. The drink container as recited in claim 9 wherein said disk portion has a spindle extending therefrom and said cap portion has a recess formed therein for receiving said spindle and for rotatably coupling said disk portion to said cap portion.

11. The drink container as recited in claim 10 wherein said spindle extends from a disk center of said disk portion, said spindle having art annular flange integrally formed therein, said recess of said cap portion has a groove integrally formed therein for receiving said annular flange of said spindle so as to allow a detachable snap-fit engagement therebetween and permit a rotational movement of said disk portion.

12. The drink container as recited in claim 9 wherein said biasing member assembly comprises:

a trough integrally formed within said cap portion;

a plunger slidably disposed within said trough between a sealed configuration and an unsealed configuration, said plunger having a piston portion and a ball anchor portion, said ball anchor portion being operatively coupled to said cap portion;

a resilient member operatively coupled to said plunger and said trough so as to bias said plunger in said sealed configuration; and a casing integrally formed within said disk portion operatively coupled to said ball anchor portion of said plunger for biasing said disk portion to said sealed configuration.

13. The drink container as recited in claim 12 wherein the biasing member further comprises a detachable trough cover for securing said plunger and said resilient member within said trough.

14. A drink container comprising:

a cup having a cup opening;

a cap portion selectively coupled to said cup so as to cover said cup opening, said cap portion having a sip well and a vent well integrally formed therein, said sip well having a sip hole integrally formed therein, said vent well having a vent hole integrally formed therein;

a disk portion rotatably coupled to said cap portion between a sealed configuration and an unsealed configuration, said disk portion having a first flange and a second flange, said first flange having a sip plug integrally formed therein; said second flange having a vent plug integrally formed therein, said sip plug sealing said sip hole in said sealed configuration, said vent plug sealing said vent hole in said sealed configuration;

a trough integrally formed within said cap portion;

a plunger slidably disposed within said trough between a sealed configuration and an unsealed configuration, said plunger having a piston portion and a ball anchor portion, said piston portion being operatively coupled to said cap portion, said ball anchor portion being operatively coupled to said disk portion;

a resilient member operatively coupled to said plunger and said trough so as to bias said plunger in said sealed configuration;

a casing integrally formed within said disk portion, said casing being operatively coupled to said plunger for biasing said disk portion to said sealed configuration;

a trough cover for securing said plunger and said resilient member within said trough; and a knob operatively coupled to said disk portion, said knob selectively disposing said disk portion to said unsealed configuration.

15. The drink container as recited in claim 14 wherein said disk portion has a spindle extending therefrom and said cap portion has a recess formed therein for receiving said spindle and for rotatably coupling said disk portion to said cap portion.

16. The drink container as recited in claim 15 wherein said spindle extends from a disk center of said disk portion, said spindle having an annular flange integrally formed therein, said recess of said cap portion has a groove integrally formed therein for receiving said annular flange of said spindle so as to allow a snap-fit engagement therebetween and permit a rotational movement of said disk portion.

* * * * *